US006451884B1

(12) United States Patent
Cowen et al.

(10) Patent No.: US 6,451,884 B1
(45) Date of Patent: Sep. 17, 2002

(54) CELLULOSIC PARTICLES AND METHODS OF MAKING THEM

(75) Inventors: Philip Edward Cowen, Coventry (GB); Richard Kinseher, Kelheim/Donau (DE)

(73) Assignee: Acordis Kelheim GmbH (DE)

( * ) Notice: Subject to any disclaimer, the term of this patent is extended or adjusted under 35 U.S.C. 154(b) by 0 days.

(21) Appl. No.: 09/600,340

(22) PCT Filed: Jan. 14, 1999

(86) PCT No.: PCT/GB99/00029

§ 371 (c)(1),
(2), (4) Date: Jul. 14, 2000

(87) PCT Pub. No.: WO99/36602

PCT Pub. Date: Jul. 22, 1999

(30) Foreign Application Priority Data

Jan. 15, 1998 (GB) ..... 9800845

(51) Int. Cl.[7] ..... C08J 5/10; C08L 1/08; C08L 1/22

(52) U.S. Cl. ..... 524/36; 524/35

(58) Field of Search ..... 524/35, 36, 37

(56) References Cited

U.S. PATENT DOCUMENTS 3,114,747 A 12/1963 Campbell
5,270,379 A * 12/1993 McAndrew et al. ..... 524/555

FOREIGN PATENT DOCUMENTS

| | | |
|---|---|---|
| EP | 692559 | 1/1996 |
| EP | 824105 | 2/1998 |
| EP | 824106 | 2/1998 |
| WO | WO96/26220 | 8/1996 |
| WO | WO 99/36604 | 7/1999 |

OTHER PUBLICATIONS

Andrzej Mackiewicz et al, "Methods of Manufacturing and Collecting Cellulosic Particles", U.S. patent application Ser. No. 09/600,342, filed Jul. 14, 2000.

Richard Kinseher et al, "Manufacture of Cellulosic Particles", U.S. patent application Ser. No. 09/600,361, filed Jul. 14, 2000.

* cited by examiner

*Primary Examiner*—James J. Seidleck
*Assistant Examiner*—U. K. Rajguru
(74) *Attorney, Agent, or Firm*—Howson and HOwson

(57) ABSTRACT

Cationic cellulose particles useful in papermaking comprise from greater than 10 up to 50 percent by weight on cellulose of a polymeric amine of weight-average molecular weight in the range from 100,000 to 1,000,000 comprising monomeric units having the formula:

$$—XCR^3((CH_2)_nNR^1R^2)(CH_2)_m—$$

where X is selected from the group consisting of a chemical bond, O and $NR^4$; $R^1$ and $R^2$ are the same or different and are selected from the group consisting of H, $C_1$–$C_4$ alkyl, phenyl and phenyl substituted with one, two or three substituents selected from the group consisting of $C_1$–$C_4$ alkyl, $C_1$–$C_4$ alkoxy, F, Cl and Br; $R^3$ and $R^4$ are independently selected from the group consisting of H, methyl and ethyl; m is an integer in the range from 1 to 4; and n is an integer in the range from 0 to 4.

4 Claims, No Drawings

CELLULOSIC PARTICLES AND METHODS OF MAKING THEM

FIELD OF THE INVENTION

This invention relates to cellulosic particles of the kind known as fibrids and to methods of making the same.

Cellulosic fibrids can be made by mixing together under turbulent conditions a spinning solution of cellulose and a coagulating liquor. One example of such a solution is viscose, which contains sodium cellulose xanthate. Examples of coagulating liquors for viscose include aqueous salt solutions and aqueous acid solutions. The fibrids so produced comprise, often predominantly, fine fibrous particles a few microns in diameter; of comparable size to the fibres in woodpulp. These fibrids may also comprise plate-like or globular particles of similar size to those fibres and of more or less irregular shape. For example, in the familiar salt figure test for viscose ripeness, viscose is mixed with aqueous sodium chloride. If the sodium chloride concentration is too low, a solution is formed; if it is too high, a more or less coherent precipitated lump is formed; but at the correct concentration, fibrids are formed. The fibrids formed in the salt figure test contain residual xanthate groups. If such fibrids are acidified, or if an acidic coagulating liquor is used, then the xanthate groups are destroyed and cellulose is regenerated.

BACKGROUND ART

Modified cellulose particles have been proposed as additives in papermaking, in particular to assist in formation of the paper web (sheet) and in sludge dewatering. In a series of papers in Das Papier (1980, vol. 34, pp. 575–579; 1981, vol. 35, pp. V33–V38 and pp. 555–562; and 1983, vol. 37, pp. 181–185), Kaufer et al. disclose cationically modified cellulose particles prepared by the reaction of woodpulp with reagents such as 3-chloro-2-hydroxypropyltrimethylammonium chloride and the use of such particles as additives in papermaking.

Philipp and Lang (Faserforschung und Textiltechnik, 1966, vol. 17, pp. 299–304) disclose the addition of poly (ethyleneimine) to diluted viscose and titration of the resulting mixture with aqueous acid. A precipitate formed at mildly or moderately alkaline pH (8–11), depending upon the exact experimental conditions. The precipitate is described as a floc, indicating that it was composed of fibrids. The first formed precipitate was believed to comprise a salt of a polymeric cation (protonated poly (ethyleneimine)) and a polymeric anion (cellulose xanthate). The authors refer to such salts generically as "symplexes". Titration was continued until the mixture became acid (pH 3), and at least partial regeneration of cellulose xanthate to cellulose occurred, thus yielding cationically modified cellulosic particles by a viscose process. Philipp and co-workers elsewhere propose the use of cationically modified cellulose particles and symplexes as additives for use in papermaking (Dawydoff et al., Acta Polymerica, 1987, vol. 38, pp. 307–313, and Philipp et al., Progress in Polymer Science, 1989, vol. 14, pp. 91–172).

WO-A-96/26220 discloses a process in which a cationic polyelectrolyte is added to diluted viscose and the resulting mixture is mixed with a coagulating and regenerating liquor such as dilute sulphuric acid to form cationic cellulosic fibrids useful as additives in papermaking. The viscose was added to the coagulating liquor, or vice versa. Such polyelectrolytes include polydialkyldiallylammonium salts, in particular polydialkyldiallylammonium chloride (polyDADMAC), dicyandiamide, dicyandiamide condensates, polyamines, polyimines such as poly (ethyleneimine), and ionenes. The viscose may contain about 30 percent by weight of the polyelectrolyte on cellulose.

DISCLOSURE OF THE INVENTION

We have found that, when viscose containing a cationic polymer such as a polymeric amine is coagulated and regenerated in an acid bath, a high proportion of the cationic polymer may dissolve in the acid bath instead of becoming incorporated (as is desired) in the precipitated and regenerated cellulose. Furthermore, some of the polymer may dissolve out of the regenerated cellulosic article during washing to remove impurities or during subsequent use. This is a significant problem, particularly in the manufacture and use of regenerated cellulosic articles which contain a high proportion of cationic polymer so as to exhibit high cationic activity and which have a high surface-to-volume ratio, for example cationic cellulosic fibrids.

According to the invention, there is provided a cationic cellulosic fibrid characterised in that it comprises from greater than 10 up to 50 percent by weight on cellulose of a polymeric amine of weight-average molecular weight in the range from 100,000 to 1,000,000 comprising monomeric units having the formula:

$$—XCR^3((CH_2)_N NR^1R^2)(CH_2)_m—$$

where X is selected from the group consisting of a chemical bond, O and $NR^4$; $R^1$ and $R^2$ are the same or different and are selected from the group consisting of H, $C_1$–$C_4$ alkyl, phenyl, and phenyl substituted with one, two or three substituents selected from the group consisting of $C_1$–$C_4$ alkyl, $C_1$–$C_4$ alkoxy, F, Cl and Br; $R^3$ and $R^4$are independently selected from the group consisting of H, methyl and ethyl; m is an integer in the range from 1 to 4; and n is an integer in the range from 0 to 4.

According to the invention, there is further provided a method for the manufacture of cationic cellulosic fibrids, including the steps of:

(a) combining viscose with an aqueous solution of a polymeric amine, thereby forming an amine-containing dope;

(b) mixing the amine-containing dope with a coagulating and regenerating liquor under turbulent conditions, thereby forming a slurry of cationic cellulosic fibrids in a spent liquor; and (c) collecting the cationic cellulosic fibrids from the spent liquor, characterised in that the amine-containing dope contains from greater than 10 up to 50 percent by weight on cellulose of a polymeric amine of weight-average molecular weight in the range from 100,000 to 1,000,000 comprising monomeric units having the formula:

$$—XCR^3((CH_2)_n NR^1R^2)(CH_2)_m—$$

where X is selected from the group consisting of a chemical bond, O and $NR^4$; $R^1$ and $R^2$ are the same or different and are selected from the group consisting of H, $C_1$–$C_4$ alkyl, phenyl, and phenyl substituted with one, two or three substituents selected from the group consisting of $C_1$–$C_4$ alkyl, $C_1$–$C_4$ alkoxy, F, Cl and Br; $R^3$ and $R^4$ are independently selected from the group consisting of H, methyl and ethyl; m is an integer in the range from 1 to 4; and n is an integer in the range from 0 to 4. The expression "spent liquor" is used as a convenient name for the byproduct liquor produced in the method of the invention; it will be appreciated that this liquor often retains some coagulating and regenerating powers.

The weight-average molecular weight of the polymeric amine is preferably in the range from 200,000 to 500,000. The polymeric amine is preferably a poly(vinylamine), for example a partially-hydrolysed poly(N-vinylformamide) as disclosed by F Linhart and W.Auhorn (Das Papier, 1992, vol. 46(10A), pp. V38–V45). EP-A-0,692,599 discloses the manufacture of cellulosic fibres which contain polymeric amines, in particular by the viscose process. The polymeric amines of EP-A-0,692,599 comprise an aliphatic backbone with pendent amine groups as specified for use in the present invention, and they are of molecular weight above 1000. The amount of polymeric amine disclosed in EP-A-0,692,599 may be in the range from 0.1 to 10, preferably from 0.3 to 3, percent by weight on the cellulose in the spinning solution (e.g. viscose). The fibres of EP-A-0,692,599 exhibit improved dyeability and increased wet and dry tenacities.

We have found that the method of the invention permits the incorporation of polymeric amine into cationic cellulosic fibrids with a high degree of efficiency and that a high proportion of the polymeric amine remains within the fibrids of the invention during aqueous processing, for example when used as additives in papermaking to assist in web formation or sludge dewatering. We have found that 80 percent or more, often 90 percent or more, of the amine becomes incorporated into the fibrids. In contrast, we have found that the efficiency of incorporation of other types of polymeric amine into cellulosic fibrids is rarely as high as 60 percent. Surprisingly, we have been unable satisfactorily to spin fibres from viscose containing more than about 3 percent by weight on cellulose of the polymeric amine used in the invention: spinning stability was extremely poor. In contrast, we have found no difficulty in spinning fibres from viscoses containing up to 25–30 or even 50–60 percent by weight on cellulose of polymeric amines outside the scope of the present invention such as aminated starch.

We have found it convenient to employ a conventional viscose suitable for fibre manufacture and to employ an amine-containing dope containing from 1 to 8 percent by weight cellulose.

The coagulating and regenerating liquor may be any of those known for viscose processes, particularly aqueous acid. Conveniently, it is dilute aqueous sulphuric acid, which is the most usual acidic component in such liquors, preferably at a concentration in the range from 0.5 to 5, more preferably from 1 to 3.5, percent by weight. If desired, the liquor may contain conventional amounts of sodium sulphate (a byproduct of the process), for example up to 25 percent by weight. This is advantageous, because the liquor can accordingly be recovered for reintroduction into the process using conventional measures such as evaporation and crystallisation. We have found that the liquor does not need to contain, and preferably contains little or no, auxiliary coagulating substances such as the zinc sulphate used in many processes for the manufacture of conventional viscose fibres. Furthermore, the presence of such substances in the fibrids produced by the method of the invention may be undesirable in some end-uses, for environmental and/or technical reasons. IL desired, the liquor may contain conventional surface-active agents as employed in other viscose processes.

The temperature of the coagulating and regenerating liquor is preferably in the range from 60 to 100° C., more preferably in the range from 80 to 95° C. Use of high temperatures makes for rapid coagulation and regeneration and assists removal of byproduct carbon disulphide and hydrogen sulphide by degassing. Degassing may be assisted by injecting steam into the slurry resulting from mixing step (b). Such sulphur-containing byproducts may be collected or disposed of in conventional manner.

The mixing step (b) is conveniently carried out by injecting both the amine-containing dope and the coagulating and regenerating liquor into a high-shear mixing chamber, for example a Y-shaped chamber, or mixing head, although any method of mixing which generates sufficient turbulence and shear to produce the desired fibrids may be employed.

The method of the invention may be carried out batchwise or continuously. The collection step may be performed using conventional methods such as settling, filtration or centrifugation. The spent liquor is preferably. recovered by conventional methods such as evaporation and crystallisation for reuse as coagulating and regenerating liquor.

Cationic activity of fibrids can be assessed by adding excess of an aqueous solution of an anionic water-soluble polymer followed by back-titrating with an aqueous solution of a cationic water-soluble polymer. The strength of the reagent solutions is conveniently about 1 millinormal. The cationic activity of the fibrids of the invention may be in the range from 500 to 5000, often 1000 to 5000, milliequivalents per kg.

The fibrids of the invention may be used in the manufacture of paper and board, including fine and speciality papers. The fibrids of the invention are useful as additives in papermaking, particularly to assist with web (sheet) formation and with sludge dewatering.

The invention is illustrated by the following Example, in which parts and proportions are by weight unless otherwise specified:

EXAMPLE

Viscose was mixed with water and aqueous solutions of various polymeric amines to give diluted viscoses containing 2–4% cellulose and known amounts of amine. These diluted viscoses were mixed with aqueous sulphuric acid (2.7%) under turbulent conditions to produce a slurry containing cationic cellulose fibrids (0.5–1%). In some experiments, the temperature of the acid was 80° C., to assist degassing; in other experiments, mixing was carried out at ambient temperature and the resulting fibrid slurry heated to 80° C. to allow degassing to occur. Fibrids were collected from the slurry by filtration, washed and analysed for nitrogen content by the Kjeldahl method. The efficiency of incorporation of the polymeric amine into the fibrids was calculated from the analytical and theoretical values for nitrogen content. The results shown in Table 1 were obtained:

TABLE 1

| Nature of amine (supplier, Trade Mark) | Amine on cellulose % | Efficiency % |
|---|---|---|
| Comparative experiments: | | |
| Aliphatic polyamine derivative (Clariant UK, Cartafix DPRS) | 24.8 | 21.9–32.4 (3) |
| Poly(ethyleneimine) (BASF, Polymin P) | 25.0 | 61.4 |
| Poly(ethyleneimine) (BASF, Polymin P) | 37.9 | 53.9 |
| Poly(ethyleneimine) (BASF, Polymin P) | 50.8 | 54.9 |
| Poly(DADMAC) (Allied Colloids, Alcofix 169) | 14.0 | 31.3 |

TABLE 1-continued

| Nature of amine (supplier, Trade Mark) | Amine on cellulose % | Efficiency % |
|---|---|---|
| Aminated starch (Südstärke, Licocat) | 63.7 | 43.2–44.1 (2) |
| Aminated starch (Südstärke, Licocat) | 127.3 | 43.8 |
| Experiments according to the invention: | | |
| Poly(vinylamine) (BASF, Basocoll PR8086) | 25.0 | 89.1 |
| Poly(vinylamine) (BASF, Basocoll PR8086) | 37.6 | 90.0 |
| Poly(vinylamine) (BASF, Basocoll PR8086) | 49.9 | 87.1 |
| Poly(vinylamine) (BASF, Catiofast PR8106) | 12.5 | 91.1–92.3 (2) |
| Poly(vinylamine) (BASF, Catiofast PR8106) | 13.4–13.8 | 96.1–99.1 (3) |
| Poly(vinylamine) (BASF, Catiofast PR8106) | 17.8–18.1 | 89.6–92.2 (2) |
| Poly(vinylamine) (BASF, Catiofast PR8106) | 37.4 | 87.8 |
| Poly(vinylamine) (BASF, Catiofast PR8106) | 50.2 | 81.0 |

Replicate experiments are indicated where relevant by numbers in parenthesis. The nominal weight-average molecular weights of both the poly(vinylamine)s was 300,000–400,000.

What is claimed is:

1. A cationic cellulosic fibrid, which comprises from greater than 10 up to 50 percent by weight on cellulose of a polymeric amine of weight-average molecular weight in the range from 100,000 to 1,000,000 comprising monomeric units having the formula:

$$—XCR^3((CH2)_2NR^1R^2)(CH2)_m—$$

where X is selected from the group consisting of a chemical bond, O and $NR^4$; $R^1$ and R2 are the same or different and are selected from the group consisting of H, $C_1$–$C_4$ alkyl, phenyl, and phenyl substituted with one, two or three substituents selected from the group consisting of $C_1$–$C_4$ alkyl, $C_1$–$C_4$ alkoxy, F, Cl and Br; $R^3$ and $R^4$ are independently selected from the group consisting of H, methyl and ethyl; m is an integer in the range from 1 to 4; and n is an integer in the range from 0 to 4.

2. A fibrid according to claim 1, wherein the weight-average molecular weight of the polymeric amine is in the range from 200,000 to 500,000.

3. A fibrid according to claim 1, wherein the polymeric amine is a poly(vinylamine).

4. A fibrid according to claim 1, which has a cationic activity in the range from 500 to 5000 milliequivalents per kg.

* * * * *

UNITED STATES PATENT AND TRADEMARK OFFICE

CERTIFICATE OF CORRECTION

PATENT NO. : 6,451,884 B1
DATED : September 17, 2002
INVENTOR(S) : Cowen et al.

It is certified that error appears in the above-identified patent and that said Letters Patent is hereby corrected as shown below:

Column 2,
Line 29, "$-XCR^3((CH_2)_N NR^1R^2)(CH_2)_m-$" should read
-- $-XCR^3((CH_2)_n NR^1R^2)(CH_2)_m-$ --

Column 3,
Line 62, "IL" should read -- If --

Column 6,
Line 5, "$-XCR^3((CH2)_2 NR^1R^2)(CH2)_m-$" should read
-- $-XCR^3((CH_2)_n NR^1R^2)(CH_2)_m-$ --
Line 8, "R2" should read -- $R^2$ --

Signed and Sealed this

Twenty-fifth Day of February, 2003

JAMES E. ROGAN
*Director of the United States Patent and Trademark Office*